US008544702B2

(12) United States Patent
Joyce et al.

(10) Patent No.: US 8,544,702 B2
(45) Date of Patent: Oct. 1, 2013

(54) DURABLE SURFACE TREATMENT AND APPLICATOR

(76) Inventors: James T. Joyce, Waynesville, NC (US); Dennis Galbreath, Wilmington, DE (US)

( * ) Notice: Subject to any disclaimer, the term of this patent is extended or adjusted under 35 U.S.C. 154(b) by 820 days.

(21) Appl. No.: 12/590,458

(22) Filed: Nov. 6, 2009

(65) Prior Publication Data

US 2011/0108585 A1 May 12, 2011

(51) Int. Cl.
*A47G 19/14* (2006.01)

(52) U.S. Cl.
USPC ..... 222/465.1; 222/1; 222/466; 222/481.5; 222/482; 222/565; 222/566; 222/567

(58) Field of Classification Search
USPC ..... 222/1, 465.1, 466, 478, 481, 481.5, 222/482, 538–539, 528–530, 565, 566, 567; 220/361, 367.1; 401/136–137; 239/377–378; 428/423.1
See application file for complete search history.

(56) References Cited

U.S. PATENT DOCUMENTS

| | | | | | |
|---|---|---|---|---|---|
| 3,159,320 | A | * | 12/1964 | Scholtz | 222/468 |
| 3,250,434 | A | * | 5/1966 | Cavill | 222/143 |
| 3,638,834 | A | * | 2/1972 | Goodrich et al. | 222/105 |
| 3,779,794 | A | * | 12/1973 | De Santis | 428/422.8 |
| 3,865,270 | A | * | 2/1975 | Petersson | 220/721 |
| 4,811,865 | A | * | 3/1989 | Mueller et al. | 222/153.08 |
| 4,811,870 | A | * | 3/1989 | Bianco | 222/461 |
| 4,923,098 | A | * | 5/1990 | Schoonover et al. | 222/465.1 |
| 5,277,343 | A | * | 1/1994 | Parsonage | 222/484 |
| 5,400,928 | A | * | 3/1995 | Resnick | 222/530 |
| 5,721,538 | A | * | 2/1998 | Tubel et al. | 340/853.4 |
| 6,017,163 | A | * | 1/2000 | Keppers et al. | 401/48 |
| 6,036,061 | A | * | 3/2000 | O'Donnell | 222/539 |
| 6,039,210 | A | * | 3/2000 | Flowers | 222/1 |

* cited by examiner

*Primary Examiner* — Frederick C Nicolas

(57) ABSTRACT

An applicator device for applying a surface treatment to create a solid surface including a storage vessel for carrying the treatment comprising two parallel sides connected by four elongated sides, an opening on a first elongated side of the vessel that permits ingress and egress of the treatment, and a pouring spout attached to the opening in the first elongated side of the vessel. The spout includes a first section proximal to the vessel that is angled with respect to the first elongated side of the vessel, and a distal end of the spout angled from the first section to be perpendicular to the first elongated side of the vessel. The distal end includes a plurality of openings to distribute the treatment.

12 Claims, 6 Drawing Sheets

DURABLE SURFACE TREATMENT AND APPLICATOR

CROSS-REFERENCE TO RELATED APPLICATIONS

This applications claims the benefit of U.S. Provisional Patent Application Ser. No. 61/198,525 filed Nov. 6, 2009, which is hereby incorporated by reference.

BACKGROUND OF THE INVENTION

There are many instances where a durable, solid surface is desired or necessary, such as paths or walkways, for example. The conventional means for providing such surfaces is often through the application of an asphalt concrete or a cement concrete. However, asphalt concrete can soften during hot weather and become brittle during cold weather. Also, cement concrete can be degraded by the application of salt or other de-icing agents commonly used during winter weather. Additionally, many types of concrete require heating, dilution, and/or mixing to cure and may emit volatile solvents.

SUMMARY OF THE INVENTION

Therefore, it is an object of the present invention to provide a surface treatment that may be applied to a coarse aggregate by an applicator device to create a durable, solid surface suitable for a variety of purpose, that does not require heating, dilution or mixing to cure and does not emit volatile solvents.

To attain the above object, according to an aspect of the invention, there is provided an applicator device including a storage vessel for carrying a liquid comprising two parallel sides connected by four elongated sides, an opening on a first elongated side of the vessel that permits ingress and egress of the liquid, and a pouring spout attached to the opening in the first elongated side of the vessel. The spout includes a first section proximal to the vessel that is angled with respect to the first elongated side of the vessel, and a distal end of the spout angled from the first section to be perpendicular to the first elongated side of the vessel. The distal end includes a plurality of openings to distribute the liquid.

Preferably, the storage vessel comprises a box shape with a height and length greater than the width.

The opening is preferably closeable by a closure device.

Preferably, the spout is removable from the vessel, and removable in the same manner as the closure device.

The applicator device preferably further includes a first handle on the first elongated side, and a second handle on an adjacent elongated side of the vessel.

Preferably, the applicator device further includes an air vent, that preferably includes a rotary knob to open and close said air vent.

The applicator device preferably is used to apply a surface treatment.

According to another aspect of the invention, there is provided a method for creating a solid surface including situating a coarse aggregate to an area, and topically applying a polyurethane prepolymer to said course aggregate.

Preferably, the polyurethane prepolymer includes a single-component liquid polyurethane.

The polyurethane prepolymer preferably includes a liquid prepolymer having a free isocyanate content of approximately 19%, wherein the liquid prepolymer includes a diphenylmethane diisocyanate and a prepolymer triol.

These and other exemplary features and advantages of the present invention will become clear from the following description with reference to the accompanying drawings.

BRIEF DESCRIPTION OF THE DRAWINGS

The foregoing and other exemplary purposes, aspects and advantages will be better understood from the following detailed description of an exemplary embodiment of the invention with reference to the drawings, in which.

DETAILED DESCRIPTION OF THE INVENTION

Figure 1:
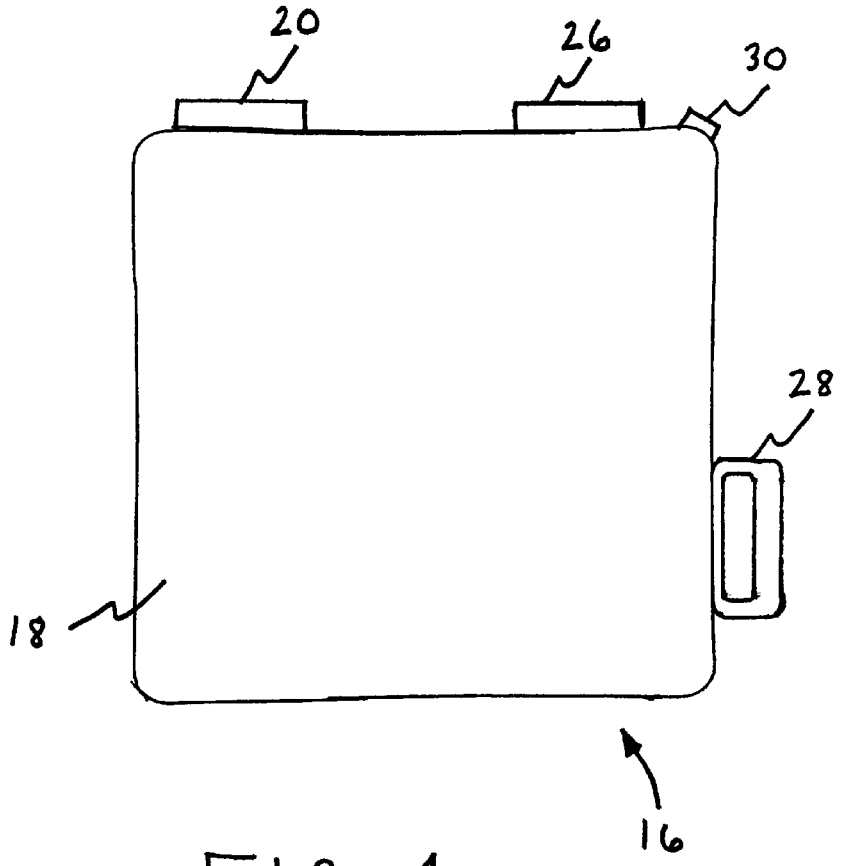
FIG. 1 shows a side view of an exemplary embodiment of the invention without the pouring spout attached.
Figure 2:
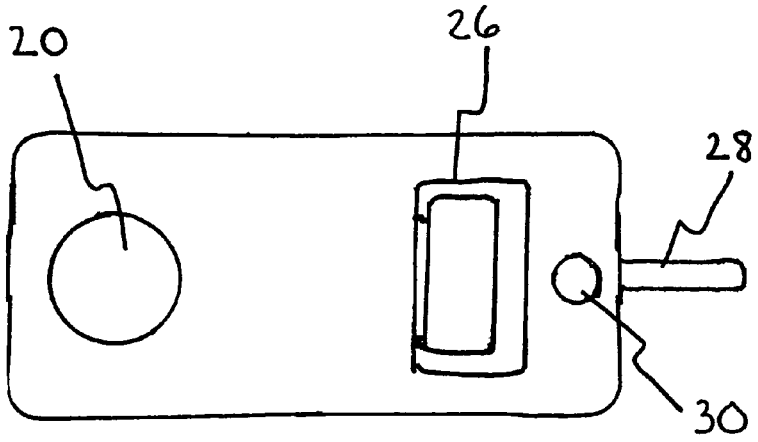
FIG. 2 shows a top view of the exemplary embodiment shown in FIG.
Figure 3:
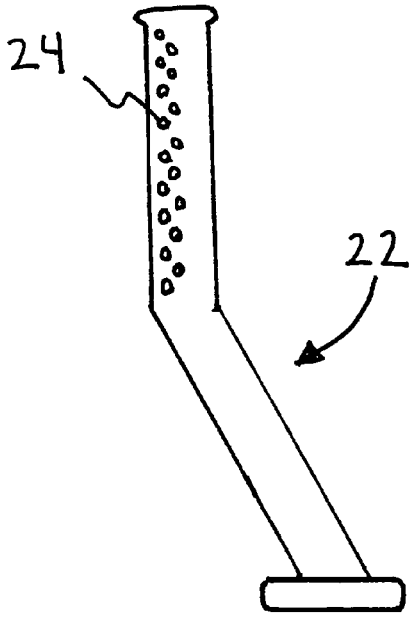
FIG. 3 shows a side view of an exemplary embodiment of the pouring spout.
Figure 4:
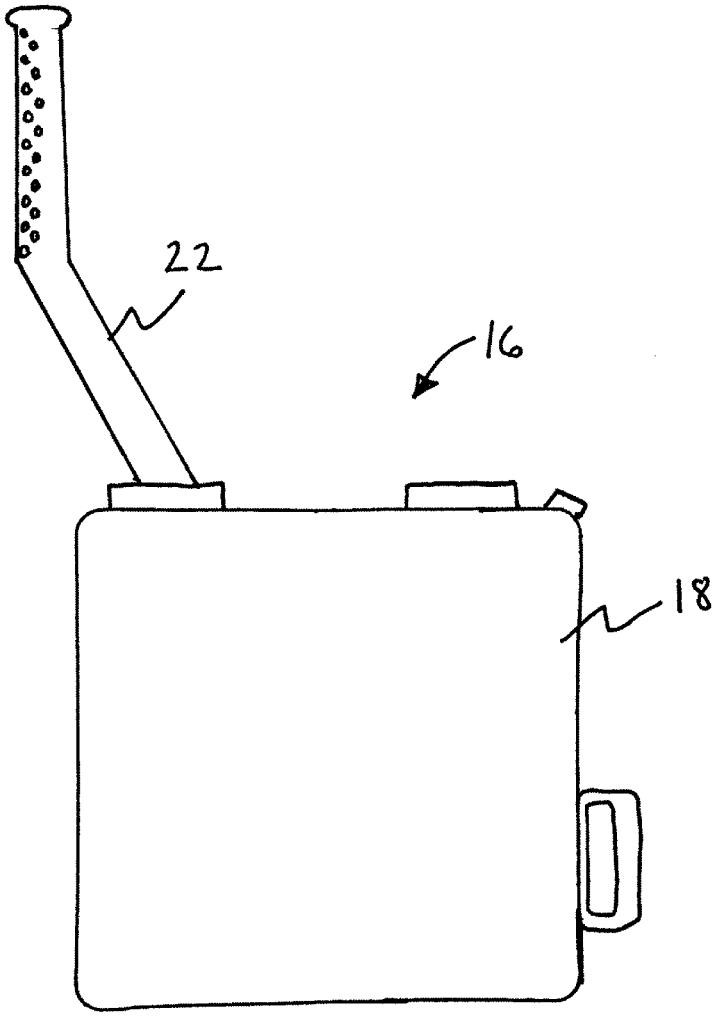
FIG. 4 shows a side view of the of the invention with the pouring spout attached.

Referring now to the drawings, and more particularly to FIGS. 1-6, there are shown exemplary embodiments of the apparatus according to the present invention.

FIGS. 1-6 show an exemplary embodiment of a surface treatment applicator for applying a surface treatment that may be applied to a coarse aggregate to create a durable, solid surface 12 suitable for a variety of purpose, such as, for example, for use on a path or walkway.

The treatment 10 preferably comprises a polyurethane prepolymer in the form of a single component liquid polyurethane. The treatment 10 is applied to a coarse aggregate and cures through reaction with any available moisture. The result is a stable, solid surface 12.

In this manner, the treatment 10 has the advantage of not requiring heating, dilution or mixing to cure and emits no volatile solvents. Additionally, the cured polyurethane surface resists softening from hot weather and embrittlement during cold weather. The cured surface 12 also will not be degraded by the application of salt or other de-icing agents commonly used during winter weather.

In a preferable embodiment of the invention, the treatment 10 comprises a diphenylmethane diisocyanate and a prepolymer triol, which results in a liquid prepolymer having a free isocyanate content of approximately 19%. The use of diphenylmethane diisocyanate offers the lowest vapor pressure and therefore a higher degree of safety for the user 14 applying the treatment 10. However, it should be understood that the liquid polyurethane may be prepared with other polyisocyanates. Likewise, a variety of polyols may be used to prepare useful formulations of the treatment 10.

The treatment 10 may be applied using a novel applicator device 16. The device 16 comprises a fluid-tight storage vessel 18 of a size suitable for carrying by a person 14. As shown in the drawings, the vessel 18 is preferably box-shaped with a height and length greater than the width. In this manner, the vessel comprises 18 two larger parallel sides connected by four smaller, elongated sides. However, it is to be understood that the shape of the vessel 18 may be any shape suitable for the function.

The vessel 18 further includes an opening 20 on a first elongated side of the vessel 18 that permits the ingress and egress of the treatment 10. This opening 20 may be opened and closed through the use of a screw cap or any other suitable closure device.

The applicator device 16 further includes a pouring spout 22 with is attached to the opening 20 in the first elongated side of the vessel 18. The spout 22 is preferably removable from the vessel 18 to facilitate transport or storage. The spout 22 is preferably attached to the vessel 18 in the same manner as the closure device used for closing the opening 20. For example, if a screw cap is used, the spout 22 would have a screw-type attachment incorporating the same threading. However, it should be understood that any suitable connection may be used, or the spout 22 may be fixedly attached.

The pouring spout 22 preferably slightly angled with respect to the first elongated side to facilitate application of the treatment 10. The distal end of the spout 22 is angled away from the rest of the spout 22, such that the distal end is approximately perpendicular to the first elongated side of the vessel 18. The terminus of the spout 22 is closed and the distal end is perforated with a plurality openings 24 to create a cylindrical delivery device for the treatment 10.

Figure 5:
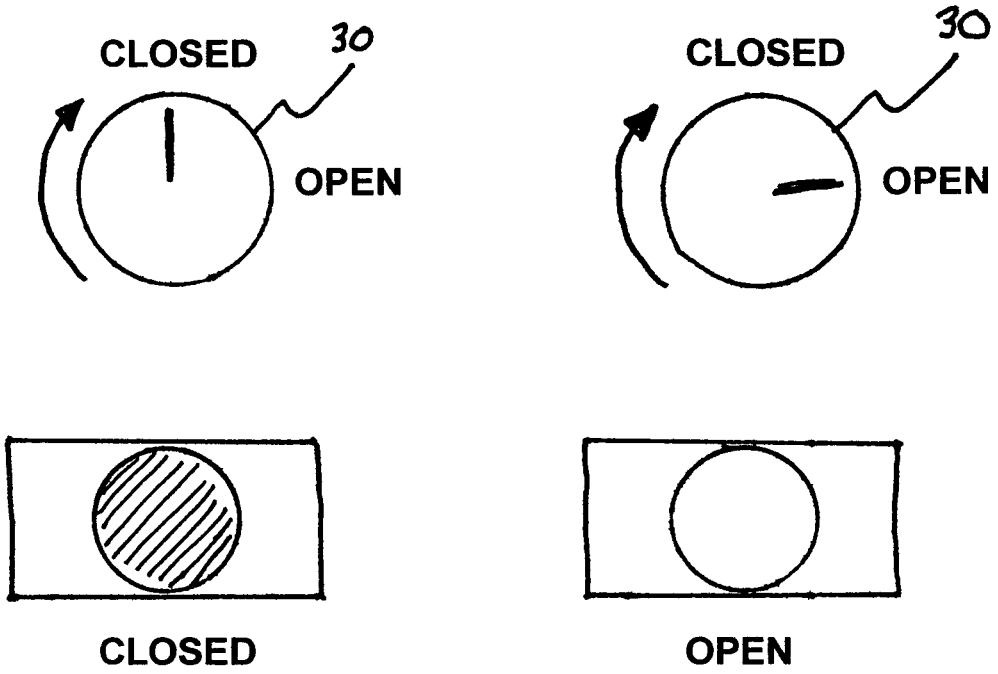
FIG. 5 shows a detailed view of an exemplary embodiment of the air vent and associated control.
Figure 6:
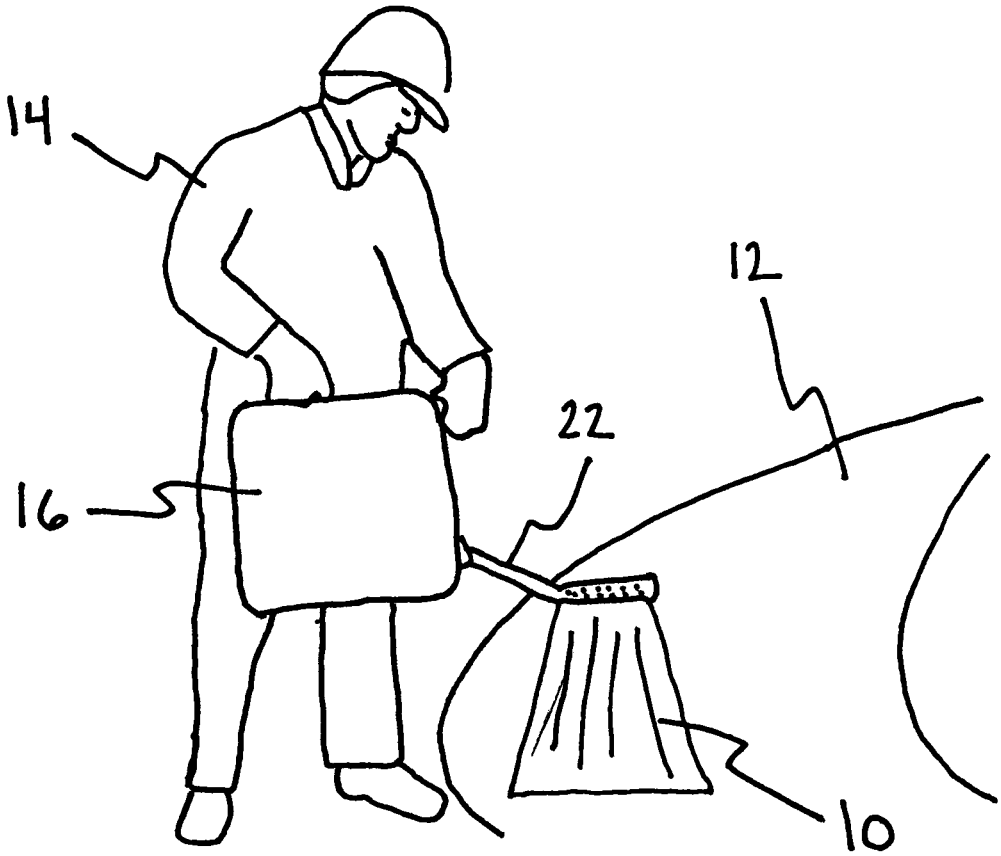
FIG. 6 shows an exemplary embodiment of the invention being used to apply a surface treatment.

The applicator device 16 further comprises a first handle 26 on the first elongated side of the vessel 18 and a second handle 28 on an adjacent elongated side to permit the user 14 to carry the device 16. The two handles 26,28 are situated so as to permit the user 14 to bear the weight of the applicator device 16 while controlling the movement of the spout 22 during application of the treatment 10. The applicator device 16 preferably further comprises an air vent 30 suitably located on the vessel to facilitate the dispersal of the treatment 10 from the device 16. As shown in FIG. 5, the air vent may comprise a rotary knob to open and close the air vent 30. However, it should be understood that any suitable openable venting device may be used.

While the invention has been described in terms of several exemplary embodiments, those skilled in the art will recognize that the invention can be practiced with modification within the spirit and scope of the appended claims.

Further, it is noted that, Applicant's intent is to encompass equivalents of all claim elements, even if amended later during prosecution.

What is claimed is:

1. An applicator device comprising:

a storage vessel for carrying a liquid comprising two parallel sides connected by four elongated sides;

an opening on a first elongated side of said vessel that permits ingress and egress of the liquid;

a pouring spout attached to said opening in said first elongated side of said vessel, said spout comprising;

a first section proximal to said vessel angled with respect to said first elongated side of said vessel; and a distal end of said spout angled from said first section and perpendicular to said first elongated side of said vessel, said distal end comprising a plurality of openings to distribute the liquid.

2. The applicator device of claim 1, wherein said storage vessel comprises a box shape with a height and length greater than the width.

3. The applicator device of claim 1, wherein said opening is closeable by a closure device.

4. The applicator device of claim 1, wherein said spout is removable from said vessel.

5. The applicator device of claim 3, wherein said spout is removable from said vessel in the same manner as said closure device.

6. The applicator device of claim 1, further comprising:

a first handle on said first elongated side; and a second handle on an adjacent elongated side of said vessel.

7. The applicator device of claim 1, further comprising an air vent.

8. The applicator device of claim 7, wherein said air vent comprises a rotary knob to open and close said air vent.

9. The applicator device of claim 1, wherein said liquid comprises a surface treatment.

10. A method for creating a solid surface comprising:

situating a coarse aggregate to an area;

topically applying a polyurethane prepolymer to said course aggregate using an applicator, having a storage vessel for carrying the polyurethane prepolymer, comprising two parallel sides connected by four elongated sides and an opening on a first elongated side of said vessel that permits ingress and egress of the polyurethane prepolymer; and pouring the polyurethane prepolymer on said course aggregate from a pouring spout attached to said opening in said first elongated side of said vessel, wherein a distal end of said pouring spout comprises a plurality of openings to distribute the polyurethane prepolymer, wherein the polyurethane prepolymer applied to said coarse aggregate cures through reaction with any available moisture to create the solid surface.

11. The method of claim 10, wherein said polyurethane prepolymer comprises a single-component liquid polyurethane.

12. The method of claim 10, wherein said polyurethane prepolymer comprises a liquid prepolymer having a free isocyanate content of approximately 19%, said liquid prepolymer comprising a diphenylmethane diisocyanate and a prepolymer triol.

* * * * *